US005978967A

United States Patent [19]

Williams

[11] Patent Number: 5,978,967

[45] Date of Patent: Nov. 9, 1999

[54] RAIN AND SHOWER CAP WITH POUCH

[76] Inventor: Cherie Williams, 12751 SE. 23rd Ave., Milwaukie, Oreg. 97222

[21] Appl. No.: 09/231,305

[22] Filed: Jan. 13, 1999

[51] Int. Cl.[6] ..... A42B 1/06

[52] U.S. Cl. ..... 2/174; 2/172; 2/202

[58] Field of Search ..... 2/68, 171, 172, 2/174, 181, 202, 205, 410

[56] References Cited

U.S. PATENT DOCUMENTS 4,400,830 8/1983 Gaitan ..... 2/68

5,455,970 10/1995 Vance et al. ..... 2/171.04

*Primary Examiner*—Diana Oleksa

*Attorney, Agent, or Firm*—William S. Lovell

[57] ABSTRACT

A cap useful for protecting against either rainwater or shower water is at least partially of transparent material that can hang down over the front of the face, the cap body portion including air vents over which flaps to keep out water are disposed. The cap further includes an integral hair pouch into which long hair, such as a pony tail, may be placed to protect that hair likewise from water. The pouch with contained hair can be allowed to hang down the back, or alternatively a hair pouch in the form of an arc within the cap interior may be used to contain the long hair or pony tail within an arc surrounding the upper neck, and leaving the lower neck and shoulders uncovered. Either of such embodiments is easily pressed into a flattened form and placed into an envelope of appropriate size so as to permit convenient storage using a minimum of shelf space.

7 Claims, 3 Drawing Sheets

RAIN AND SHOWER CAP WITH POUCH

BACKGROUND OF THE INVENTION

1. Field of the Invention

This invention relates to caps worn on the head to protect from water falling into the hair, e.g., as when in the shower or from rain, and particularly to caps having a pouch for containment of long hair such as a pony tail or the like, and also having a shield to protect the face from water.

2. Background Information

It is well known to use a cap, hat or similar such device when outdoors for protection of the head against rain, and also to wear a cap in the shower in order that the hair may be kept dry. Typical such caps, however, extend only over the upper region of the head, so that significant portions of the neck and shoulders remain unprotected. As a consequence, persons who have long hair in the back, e.g., even extending to the waist or further, are not provided with means for preventing rain or shower water from drenching that long hair.

Also, occasions arise when, for example, a lady has carefully applied makeup to her face and would like to take a shower without disturbing that makeup. Similar needs may arise, for example, when a person suffers from medical conditions involving the face, or has had eye or ear surgery or the like, and may have bandages or dressings applied to the head or face that should not become wet by rain or in the shower. No prior art rain or shower caps of which this inventor is aware provide any means for protecting the face, as well as the hair, from either rain or shower water.

Typical of existing caps is that described in U.S. Pat. No. 4,400,830 issued Aug. 30, 1983, to Gaitan. A feature of this device is the inclusion of an upwardly-extending frame that maintains the crown of the device upwardly away from the hairdo. A related device described in U.S. Pat. No. 5,455,970 issued Oct. 10, 1995 to Vance et al. has a pliable crown extending upwardly from a headband, the crown being adjustable in height so as to accommodate different styles of hairdo. Neither of such devices, however, nor any other of which the inventor is aware, is convenient for use by a person having a style of hairdo that is not formed atop the head but is instead allowed to hang freely down the back, whether naturally or as a pony tail or braids or the like, and neither do any such devices provide any protection for the rest of the head, including the face. It is the purpose of the present invention, therefore, to provide a shower or rain cap that has the advantages both of permitting convenient means for protecting either styled or naturally flowing long hair from rain or shower water, while also protecting the rest of the head, including the face.

SUMMARY OF THE INVENTION

The invention comprises a transparent rain or shower cap having enclosed therein a pouch on a rearward location thereof into which may be folded a person's long hair, e.g., as a pony tail or the like, in order that such hair may remain dry when in a shower or outdoors in the rain. Protection against water is also provided by way of a shield portion of the cap that extends fully around the head, especially including the face, for the protection of makeup or various medical conditions, including bandages, eye shields, or the like. Air vents covered by overhanging water shields are provided around the sides of the shield portion to permit free breathing, and a set of mutually parallel, vertically displaced hoops within the cap structure serves to maintain the cap outwardly away from the head except at a single contact atop the crown. The flexible structure of the present invention also permits the same to be flattened into a form that can be inserted into an appropriately sized envelope for storage, e.g., to be laid close up against a wall of a bathroom cabinet rather than requiring a large space on a cabinet shelf

DETAILED DESCRIPTION OF THE INVENTION

Figure 1:
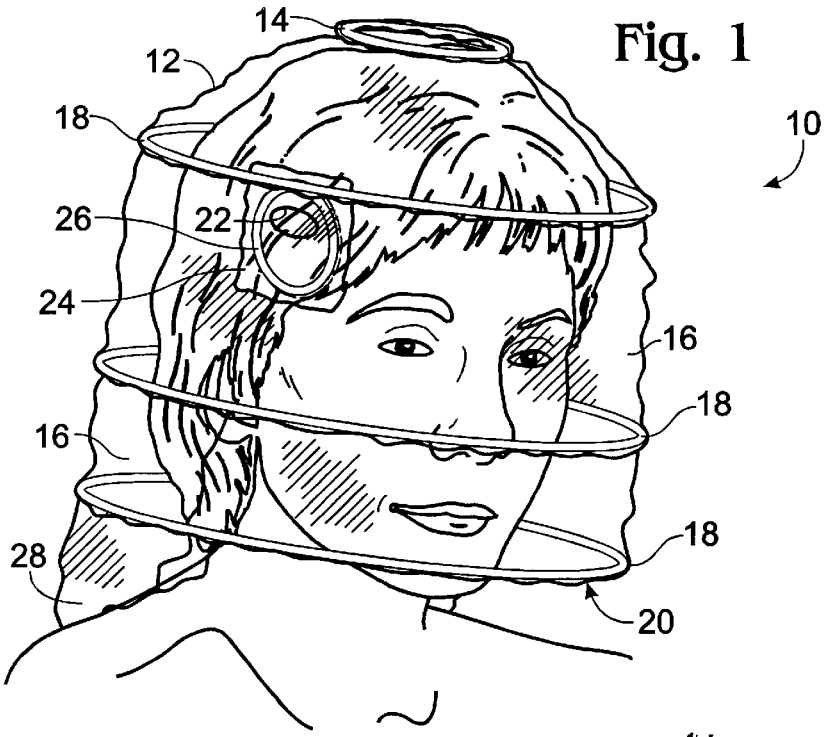
FIG. 1 is a perspective view of a preferred embodiment of the invention as being worn by a lady.

FIG. 1 depicts cap 10, preferably formed from a sheet of transparent plastic such as 1.5 mm polyethylene, in a perspective view as worn by a person. Cap 10 includes a crown portion 12 that has near an upper end thereof a crown hoop 14, that may be conveniently formed from 300 lb test monofilament fishing line that has been configured and melded into a circle. Cap 10 further includes a cylindrical body portion 16 that when cap 10 is worn extends downwardly so as to encircle the entire head. Additional hoops 18, also formed into circles from appropriate lengths of plastic rod, disposed vertically along body portion 16 and are structurally integral therewith, thus serving to hold body portion 16 outwardly away from the face and hair.

Cap 10 preferably has a length as a whole such that when worn, lower end 20 thereof becomes disposed near to the chin or shoulders of a person wearing the same, as may be preferred.

Cap 10 further includes air vents 22 disposed about the periphery of body portion 16, of which a single air vent 22 is shown in FIG. 1. A cover flap 24, preferably reinforced by a vent guard 26 that is structurally integral therewith and conveniently formed also from a length of plastic rod, is attached to body portion 16 at a point above air vent 22 to hang downwardly therefrom, thus serving to cover over air vent 22 and prevent rain or shower water from entering therein. Vent guard 26 serves specifically to prevent cover flap 24 from adhering to the plastic material surrounding air vent 22 and preclude the venting of air therethrough.

Figure 2:
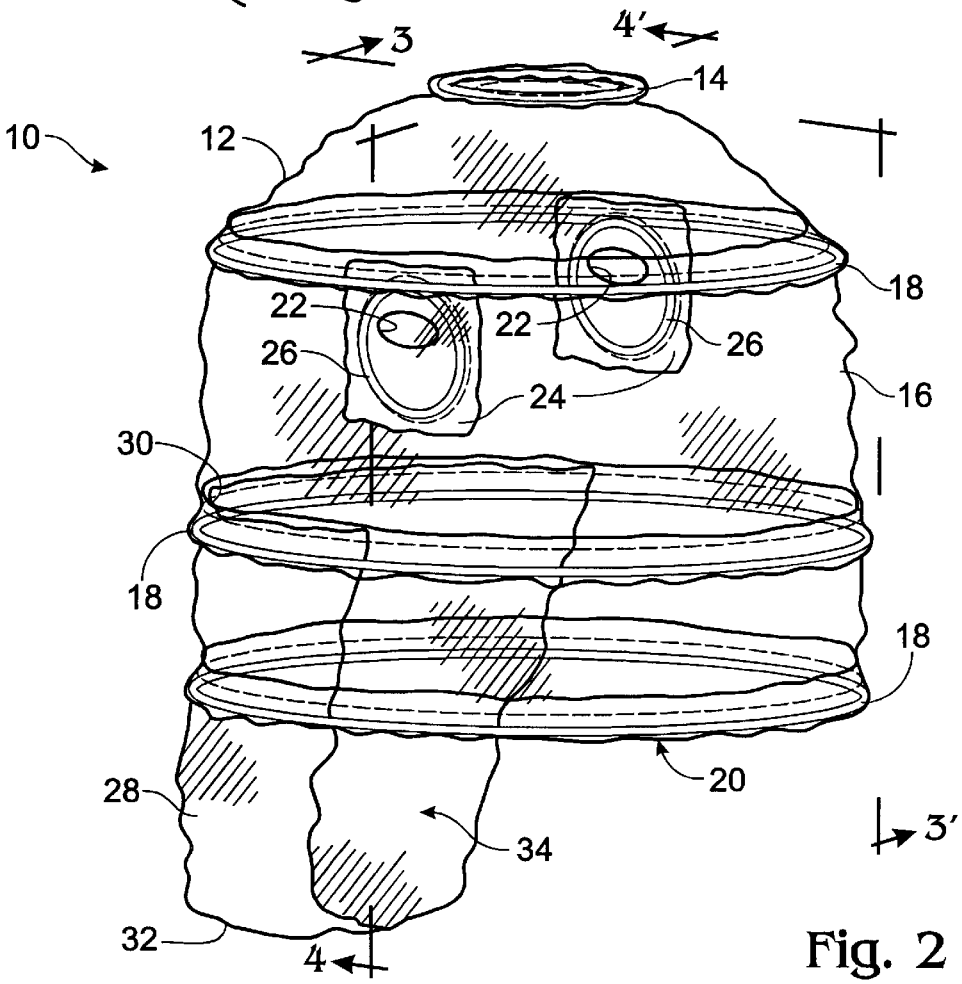
FIG. 2 is another perspective view of the cap of FIG. 1, especially showing a downwardly extending hair pouch.

As shown partially in FIG. 1 but more completely in FIG. 2, which is a perspective view of cap 10, is a hair pouch 28 that essentially comprises a pouch or bag likewise of plastic of which an outer and upper end portion 30 is attached to an inner surface of body portion 16, and for strength purposes preferably at a location coincident with the location of a hoop 18. The outer and upper end portion 30 of hair pouch 28 extends along the inner periphery of body portion 16 a distance sufficient to define a size of hair pouch 28 that will accommodate the entirety of hair that may hang downwardly from the head of a user.

Hair pouch 28 further includes a generally horizontally-disposed bottom portion 32 to provide upward support to the downwardly hanging hair of a user. As shown in FIG. 2, the inwardly facing region 34 of hair pouch 28 can be left open towards the neck of the user, or if desired could also be enclosed. Unlike prior art shower or rain caps, therefore, the downwardly hanging hair of a user, whether hanging naturally or in the form of a ponytail or the like, is likewise protected from shower or rain water.

Figure 3:
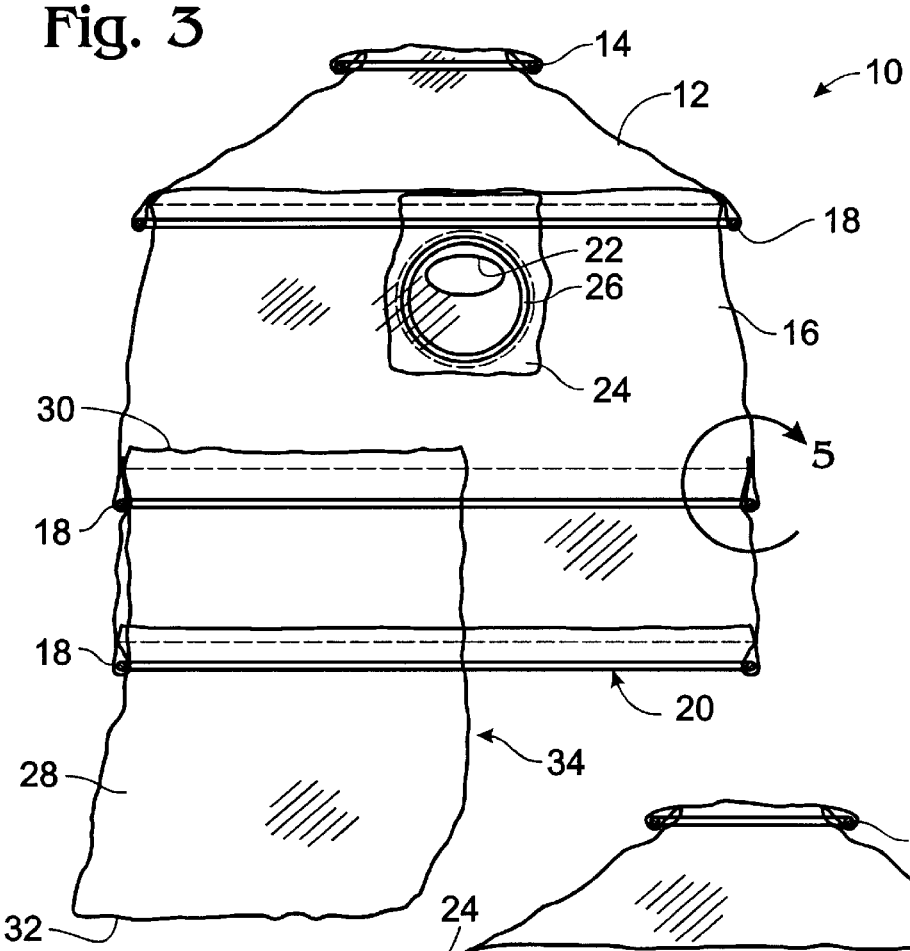
FIG. 3 is a side elevational cross-sectional view of the cap of FIG. 2 taken along the lines 3–3'.
Figure 4:
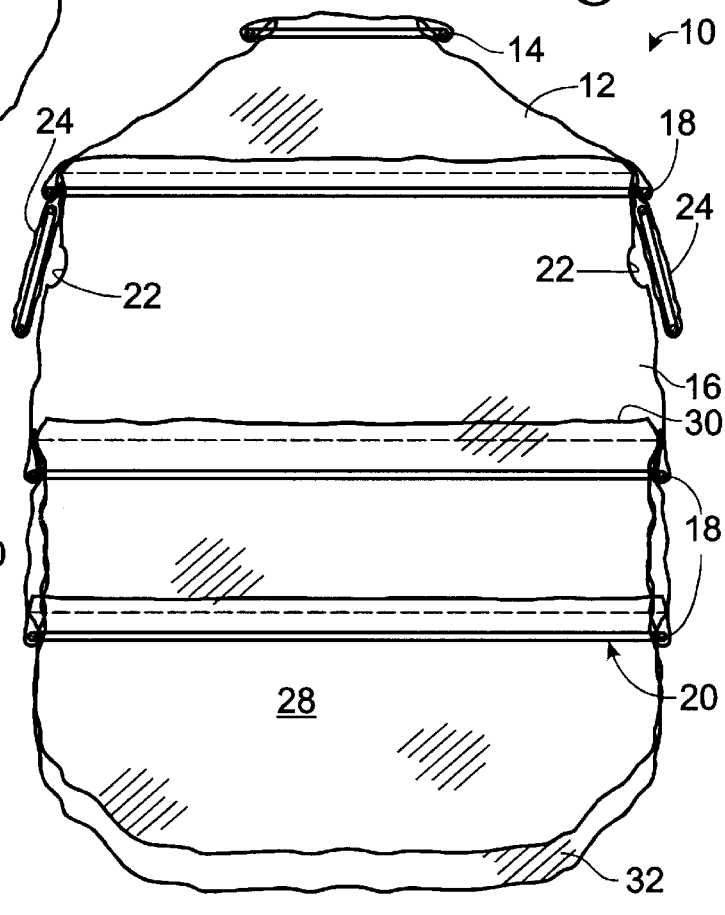
FIG. 4 is a rearward-facing elevational cross-sectional view of the cap of FIG. 2 taken along the lines 4–4' and particularly showing the manner of providing air vents around the periphery of the cap together with covering water shields therefor.

FIG. 3 is a longitudinal cross-sectional view of cap 10 taken along the lines 3–3' of FIG. 1, for purposes of subsequently illustrating the manner in which hoops 18 are structured within body portion 16. FIG. 4 is a transverse cross-sectional view of cap 10 taken along the lines 4–4' of FIG. 1, and shows the manner in which cover flaps 24 are outwardly disposed over air vents 22 so as to ensure the free flow of air through the latter.

Figure 5:
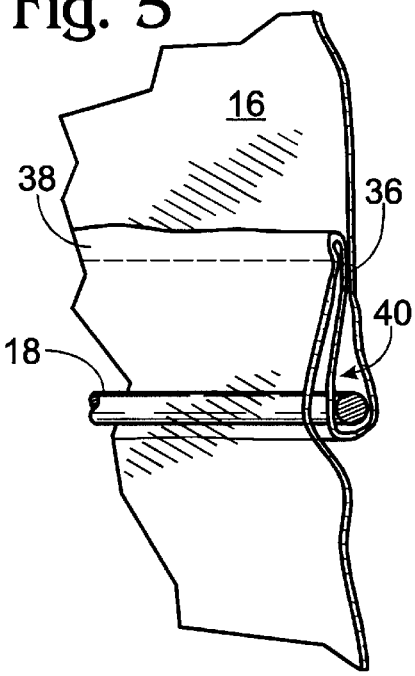
FIG. 5 is a cutaway detail of the cap of FIG. 4, illustrating the manner of forming support hoops within the cap structure.

FIG. 5 is an enlarged, cutaway view of region 5 in FIG. 3 and shows a manner in which hoops 18 may conveniently be formed within body portion 16. An elongate fold 36 is formed within the material of body portion 16 and extends fully circumferentially therearound, whereby fold 36 can later to be attached at a distal edge 38 thereof to the inner surface of body portion 16 at an upward location thereon, thereby to define a hoop channel 40. Hoop 18 having a diameter commensurate with that of body portion 16 is then placed within hoop channel 40 and distal edge 38 is attached to body portion 16, e.g., by glue or the like.

Figure 6:
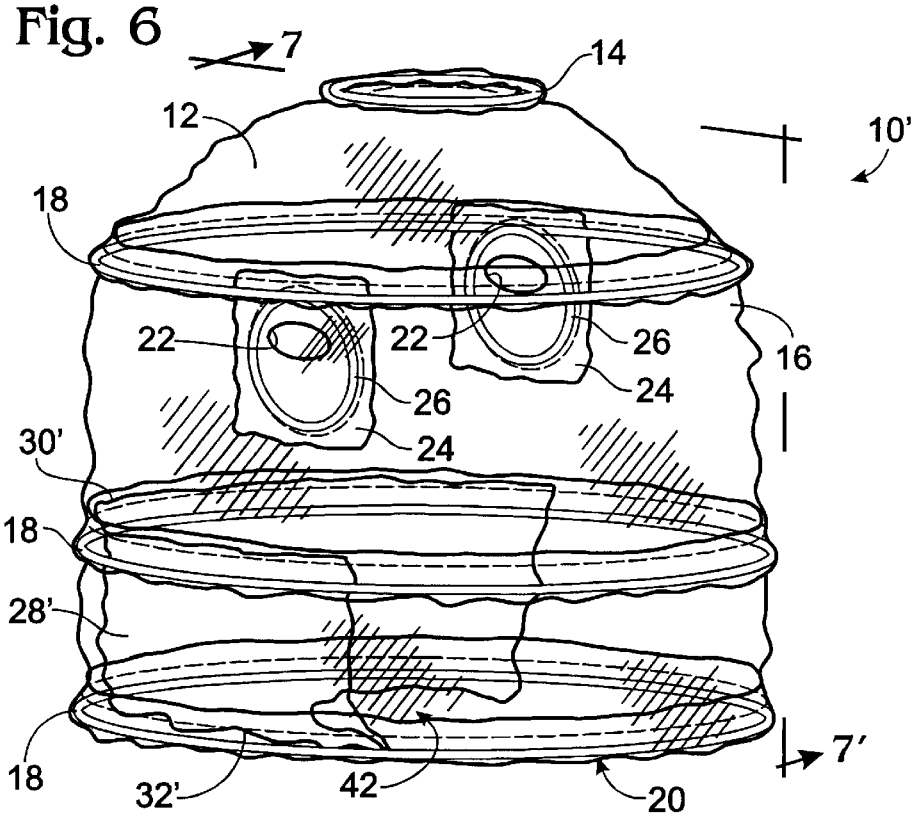
FIG. 6 is a perspective view of an alternative embodiment of the invention wherein the hair pouch is disposed around the inner periphery of and entirely within the downward extent of the cap.
Figure 7:
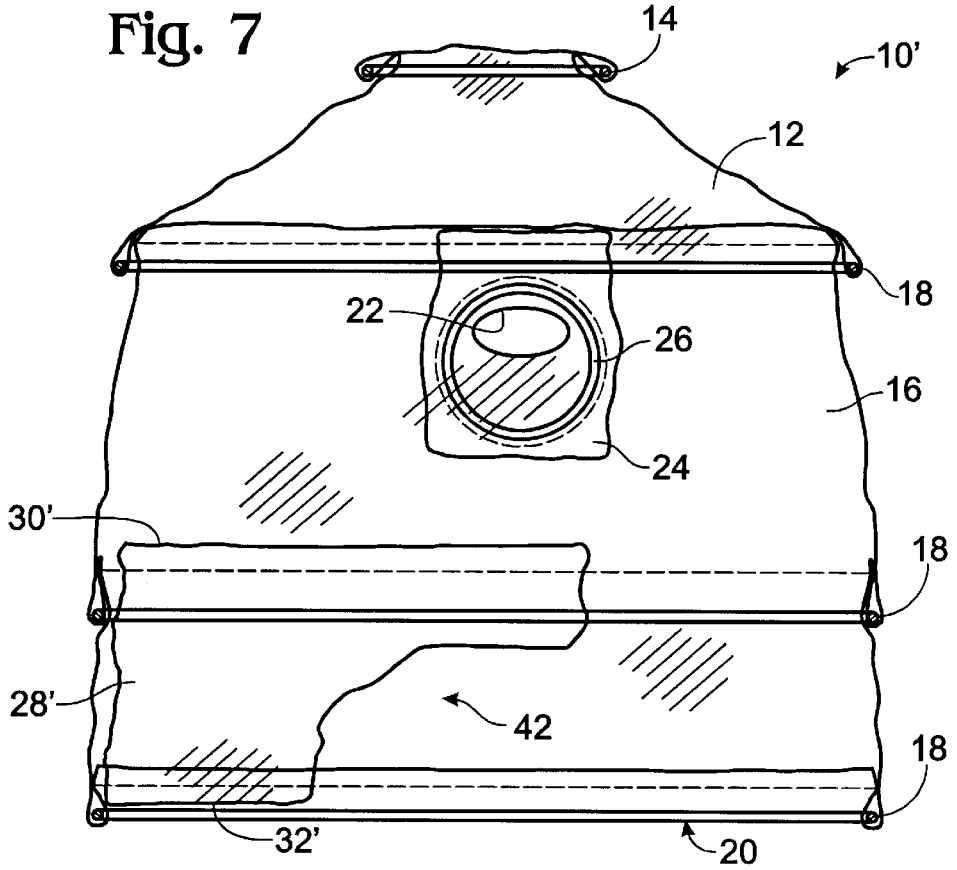
FIG. 7 is a side elevation view of the cap of FIG. 6.

FIG. 6 shows a perspective view of alternative cap 10' having a hair pouch that instead of hanging downwardly from body portion 16 as in cap 10 is disposed around the interior thereof so as not to descend below lower end 20. In FIGS. 6 and 7, portions of alternative cap 10' that are the same as those of cap 10 are numbered as before, while portions that differ are given primed numbers as with alternative cap 10' itself. Specifically, FIGS. 6, 7 show hair pouch 28' in alternative cap 10' to be disposed circumferentially in an arc therewithin, attached to body portion 16 through an outer and upper end portion 30' that extends further around body portion 16 than in cap 10, and again preferably at a location near to a hoop 18 for purposes of support. Again for purposes of supporting a quantity of hair contained within alternative hair pouch 28', alternative bottom portion 32' of alternative hair pouch 28' has an extent corresponding to a radius of an arc defined by the circumferential extent of alternative upper end portion 30' of alternative hair pouch 28', but includes a neck aperture 42 to accommodate the neck of a user.

FIG. 7 is a longitudinal cross-sectional view of alternative cap 10' taken through the lines 7–7' of FIG. 6, and particularly shows the greater circumferential extent of hair pouch 28' as compared to hair pouch 28 of cap 10. An advantage of using alternative cap 10' as opposed to cap 10 is that hair pouch 28' holds an amount of hair equivalent to that held by hair pouch 28, but in a position upward from the neck for convenience in washing the neck, i.e., the hair is folded in an arc in both directions around the base of the skull, and for that purpose the height of cap 10 may be established so that lower end 20 of body portion 16 becomes placed near to the chin rather than further down towards the shoulders. That is, if cap 10 is used, the back of the neck will be covered over by hair pouch 28 in any event, so a longer body portion 16 (descending lower than the level of the chin) might as well be used, but when using cap 10' in which the hair may be removed from the back of the neck, use of a shorter body portion 16 may be desired.

Because of the flexible nature of the plastic material forming body portion 16, either of caps 10 or 10' is easily flattened into a disk-like form wherein hoops 18 are brought close together, thereby facilitating placement of the device as a whole within an envelope of appropriate size for convenient storage close against a wall of a bathroom cabinet, rather than requiring the large space that would be necessary for storage of any rigid cap device.

Other arrangements and dispositions of the aforesaid or like components, the descriptions of which are intended to be illustrative only and not limiting, may also be made without departing from the spirit and scope of the invention, which must be identified and determined only from the following claims and equivalents thereof.

I claim:

1. A cap for protecting the head from rain or shower water comprising:

a bag-like structure having an open end that fits downwardly over the head of a person; and a hair pouch disposed along an arc segment of an inner circumference of said open end;

wherein at least a portion of said bag-like structure is formed of transparent material, said portion being disposed in an arc opposite to said arc segment along which is disposed said hair pouch.

2. The cap of claim 1 further comprising a plurality of reinforcing bands disposed mutually parallel and circumferentially at pre-determined mutual separations within said bag-like structure.

3. The cap of claim 1 further comprising a plurality of air vents disposed about said bag-like structure, whereby air is allowed to pass therethrough.

4. The cap of claim 3 wherein each of said plurality of air vents has disposed thereabove and is covered over by a corresponding shield flap, whereby downwardly descending water is precluded from entering said air vents.

5. The cap of claim 4 wherein each of said shield flaps further comprise reinforcement structures disposed therewithin, whereby an inner surface of each of said shield flaps is held outwardly from a corresponding one of said air vents.

6. The cap of claim 1 wherein said hair pouch is vertically elongate and has respectively contiguous inner, side and outer surfaces and a bottom end, said inner surface being adapted to be disposed in the direction of the neck of user, and said bottom end being adapted to be disposed towards a midline between the shoulders of a user, whereby the hair of a user may be placed therewithin to rest on said bottom end.

7. The cap of claim 1 wherein said hair pouch is horizontally elongate and extends in an arc circumferentially within an inner surface of said bag-like structure so as to encircle the neck of a user.

* * * * *